US010617895B2

(12) United States Patent
Navez et al.

(10) Patent No.: US 10,617,895 B2
(45) Date of Patent: Apr. 14, 2020

(54) DEVICE FOR INFLATING MULTIPLE ENVELOPES

(71) Applicant: NIC IMPEX, Annecy (FR)

(72) Inventors: Nicolas Navez, Villaz (FR); Jean-Michel Schmetz, Kettenis (BE); Patrick Giraudon, Veyrier-du-Lac (FR)

(73) Assignee: NIC IMPEX (FR)

( * ) Notice: Subject to any disclaimer, the term of this patent is extended or adjusted under 35 U.S.C. 154(b) by 220 days.

(21) Appl. No.: 15/576,076

(22) PCT Filed: May 24, 2016

(86) PCT No.: PCT/FR2016/051218
§ 371 (c)(1),
(2) Date: Nov. 21, 2017

(87) PCT Pub. No.: WO2016/189242
PCT Pub. Date: Dec. 1, 2016

(65) Prior Publication Data

US 2018/0140875 A1 May 24, 2018

(30) Foreign Application Priority Data

May 27, 2015 (FR) ..... 15 54746

(51) Int. Cl.
*A62B 33/00* (2006.01)
*A63B 29/02* (2006.01)
(Continued)

(52) U.S. Cl.
CPC ..... *A62B 33/00* (2013.01); *A63B 29/021* (2013.01); *A62B 99/00* (2013.01); *A63B 29/00* (2013.01);
(Continued)

(58) Field of Classification Search
CPC ..... A62B 33/00; A62B 99/00; A63B 29/021; A63B 29/00; B63C 9/00; B63C 2009/0023
See application file for complete search history.

(56) References Cited

U.S. PATENT DOCUMENTS 4,635,754 A * 1/1987 Aschauer ..... A62B 99/00 182/3
4,943,252 A * 7/1990 Manix ..... A63B 29/021 441/87
(Continued)

FOREIGN PATENT DOCUMENTS

EP 1 069 041 A2 1/2001
EP 2 548 619 A2 1/2013

OTHER PUBLICATIONS

International Search Report (with English translation) dated Aug. 22, 2016 for International Application No. PCT/FR2016/051218.
(Continued)

*Primary Examiner* — Nicolas A Arnett
(74) *Attorney, Agent, or Firm* — Fay Sharpe LLP

(57) ABSTRACT

A portable safety device (100) for inflating multiple envelopes includes at least one inlet for surrounding air (1), at least one inflation system, at least one enriched air or gas zone, at least one nonreturn valve (2), at least one connector (3) connected to the at least one inflatable envelope (4). The device also includes at least one separation wall (8), which compartmentalizes at least the end of at the connector (3) opening into at least two substantially hermetically independent inflatable envelopes (4).

12 Claims, 4 Drawing Sheets

(51) Int. Cl.
*B63C 9/00* (2006.01)
*A62B 99/00* (2009.01)
*A63B 29/00* (2006.01)

(52) U.S. Cl.
CPC ..... *B63C 9/00* (2013.01); *B63C 2009/0023* (2013.01)

(56) References Cited

U.S. PATENT DOCUMENTS 6,220,909 B1 4/2001 Aschauer et al.
6,270,386 B1 * 8/2001 Visocekas ..... A41D 13/018 441/104
7,261,608 B2 * 8/2007 Haddacks ..... A41D 13/018 2/455
7,270,077 B2 * 9/2007 Beck ..... A62B 33/00 116/209
7,878,141 B2 * 2/2011 Paynton ..... A62B 33/00 116/210
8,720,751 B2 * 5/2014 Alsaffar ..... A45F 4/10 224/153
8,777,684 B2 7/2014 Grutta et al.
8,851,948 B2 * 10/2014 Grutta ..... A62B 33/00 116/210
8,851,949 B2 * 10/2014 Grutta ..... A62B 33/00 116/210
9,004,116 B2 * 4/2015 Walker ..... A62B 33/00 141/10
9,289,633 B2 * 3/2016 Walker ..... A62B 33/00
9,440,133 B2 * 9/2016 Davis ..... A63B 69/18
9,492,711 B2 * 11/2016 Walker ..... B63C 9/18
9,770,626 B2 * 9/2017 Rose ..... A45F 3/04
9,814,938 B2 * 11/2017 Schaer ..... A62B 33/00
10,238,918 B1 * 3/2019 Huot ..... A45F 3/04
2012/0060267 A1 3/2012 Blenkarn et al.
2013/0019994 A1 1/2013 Schaer et al.
2013/0283510 A1 10/2013 Berchten et al.
2016/0016043 A1 * 1/2016 Rose ..... A45F 3/04 441/114
2018/0078823 A1 * 3/2018 Wieczorek ..... A62B 33/00
2018/0140875 A1 * 5/2018 Navez ..... A62B 33/00
2019/0030379 A1 * 1/2019 Schaer ..... A62B 33/00
2019/0106185 A1 * 4/2019 Kuder ..... B63C 9/00

OTHER PUBLICATIONS

Written Opinion (with English translation) dated Aug. 22, 2016 for International Application No. PCT/FR2016/051218.
International Preliminary Report on Patentability (with English translation) completed Nov. 28, 2017 for International Application No. PCT/FR2016/051218.

* cited by examiner

DEVICE FOR INFLATING MULTIPLE ENVELOPES

The present invention relates to a portable nonreturn valve device capable of inflating multiple envelopes during an avalanche trigger.

A safety device is based on the inflation of an air bag envelope, to reduce or prevent the burial of a user when he/she is carried off by an avalanche.

Conventional devices allow the inflation of an envelope by surrounding air suction, caused by a compressed gas supply, accelerated by the venturi effect, as described by documents U.S. Pat. No. 6,220,909, US 2013/0283510 and EP 2 548 619.

New devices have been developed in recent years, allowing inflation of an envelope only by surrounding air, blown by an electrically powered turbine, as disclosed by US 2012/0060267 and U.S. Pat. No. 8,777,684.

The major disadvantage of a device with an independent envelope is that it is unusable during a malfunction of the deployment of the envelope, a burst, a tear or a piercing of the latter.

Document U.S. Pat. No. 6,220,909 discloses a nonreturn valve system with two independent envelopes, inflated by a cylinder of compressed gas. Each of the envelopes is associated with an intake chamber, a venturi effect system and an acceleration cone.

This multi-envelope device has the advantage of having independent inflation systems, but is therefore bulky, heavy and cumbersome to carry.

US 2012/0060267 discloses a turbine inflating system, fed by a double inlet, opening into two inflatable envelopes. These two inflatable envelopes are not independent and do not work in the case of possible deterioration.

The present invention thus provides a portable safety device capable of inflating multiple envelopes in order to overcome the aforementioned drawbacks.

Thus according to the invention, the portable nonreturn valve device capable of inflating multiple envelopes comprises at least one inlet of surrounding air, at least one means of inflation, at least one enriched air or enriched gas zone, at least one nonreturn valve, at least one acceleration cone connected to at least one inflatable envelope, while it comprises at least one separation wall, which compartmentalizes at least the end of at least one acceleration cone opening into at least two substantially hermetically independent inflatable envelopes.

According to an alternative, the device comprises at least one compressed gas inlet, at least one intake chamber connecting at least one inlet of surrounding air, at least one acceleration cone and at least one intermediate venturi effect chamber. The intake chamber corresponds to an enriched gas zone, while the intermediate chamber(s) is/are located between at least one compressed gas inlet and at least one intake chamber.

According to another alternative, at least one surrounding air inlet, arranged upstream, is connected to a turbine, powered by an electrical source, while a zone located downstream from the turbine corresponds to an enriched air zone.

According to one embodiment, the separation wall compartmentalizes at least one air or enriched gas zone to at least the end of at least one acceleration cone emerging in at least two inflatable envelopes.

According to another embodiment, the separation wall compartments at least the surrounding air inlet at least the end of at least one acceleration cone opening in at least two inflatable envelopes.

According to one embodiment, the separation wall compartmentalizes at least a portion of at least one acceleration cone, at least one non-return valve, at least the end of at least one accelerating cone opening in at least two inflatable envelopes.

According to one feature, at least one separation wall forms with the inner wall of at least one acceleration cone, ducts closed at one of their ends by at least one nonreturn valve, and at their other ends, each connected to an inflatable envelope.

According to one embodiment, at least one nonreturn valve is located at the level of the inlet for surrounding air.

According to another embodiment, at least one nonreturn valve is located at the end of at least one acceleration cone emerging in at least two inflatable envelopes.

According to another embodiment, the device comprises at least two separation walls for inflating at least three inflatable envelopes.

According to one embodiment, at least one acceleration cone has an end that comprises multiple openings capable of cooperating with multiple inflatable envelopes.

Other features and advantages of the invention will become apparent from the description which follows, with reference to the accompanying drawings which are given by way of non-limiting examples.

Figure 1:
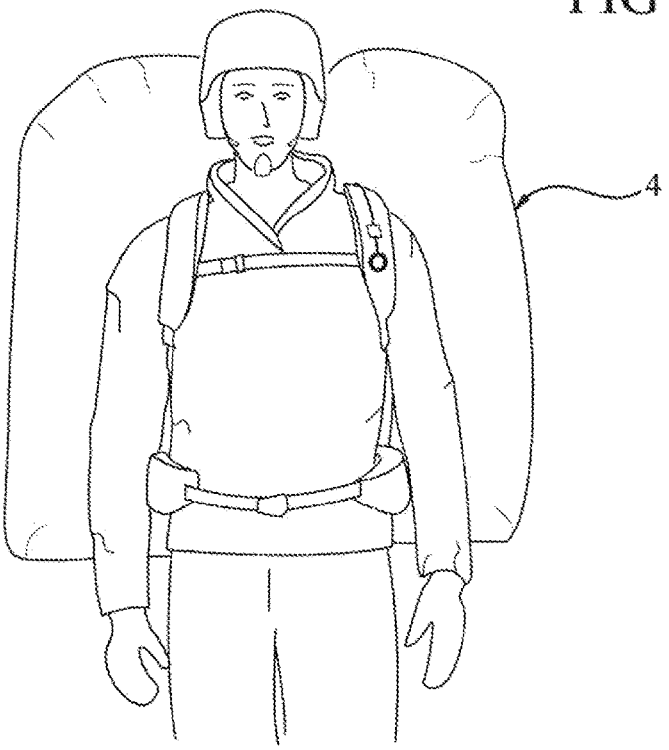
FIG. 1 is a general schematic view, according to one embodiment of the invention.

Thus, according to one alternative, the device (100) of the present invention comprises, in general, at least one inflatable envelope (4), preferably at least two inflatable envelopes (4), connected to at least one acceleration cone (3), at least one energy source such as a compressed gas cylinder (12), as a means of inflation, a user activation mechanism such as a handle (15), at least one mechanism for releasing the energy source such as a firing pin (14), at least one inflation mechanism such as a venturi mechanism combined with an air intake chamber (6), corresponding to an enriched gas zone, at least one nonreturn valve (2) and a carrying system such as a backpack or a vest.

According to another alternative, the device (100) of the present invention generally comprises at least one acceleration cone (3) connecting at least one inflatable envelope (4), preferably at least two inflatable envelopes (4), at least one inflation mechanism such as an electric system operating a turbine (11), as a means of inflation, the outlet of the turbine (11) corresponding to an enriched air zone, at least one energy source such as a battery (13), a user activation mechanism such as a handle (15), at least one mechanism for releasing the energy, source such as a printed circuit board (PCB), connected to a motor of a turbine (11), at least one nonreturn valve (2) and a carrying system such as a backpack or a vest.

According to one embodiment, at least one separation wall (8) runs through the device (100) from at least the inlet for surrounding air (1) to at least the end of an acceleration cone (3) opening into at least two inflatable envelopes (4).

According to another embodiment, at least one separation wall (8) runs through the device (100) from at least one enriched gas zone, at at least the end of an acceleration cone (3) opening into at least two inflatable envelopes (4).

According to another embodiment, at least one separation wall (8) runs through the device (100) from at least one non-return valve (2) at least the end of an acceleration cone (3) opening into at least two inflatable envelopes (4).

Note that at least one separation wall (8) allows the inflation of at least two independent inflatable envelopes (4).

Note that at least one separation wall (8) is substantially hermetic and advantageously partitions from one end to the other, transversely, the device (100).

At least one separation wall (8) thus allows the partitioning of each of the inflatable envelopes (4), making the latter substantially hermetic and independent, with respect to each other.

At least one partition wall (8) forms with the inner wall of the device (100), and more particularly the acceleration cone (3), independent ducts (9). These ducts (9) are advantageously closed by at least one nonreturn valve (2).

It is understood that the device (100), more specifically it is understood that each of the ducts (9) is considered substantially hermetic, to the effect that the injected air pressure is sufficiently substantial and that the device (100) and the ducts (9) are sufficiently sealed so that the inflatable envelopes (4) remain sufficiently inflated, at least at the time of the discharge of the avalanche and the time when the user risks being carried away by the latter.

It is also understood that a duct (9) connected to at least one inflatable envelope (4) are considered substantially hermetic and therefore also considered as independent.

At least one separation wall (8) runs through the device (100), namely, according to the embodiments described in the following description, from at least one air inlet chamber (6), thus forming a number of intake chambers (6), and at least one acceleration cone (3), thus forming a number of acceleration cones (3).

It is understood that in the rest of the description, reference is made to an intake chamber (6) for a number of adjacent admission chambers (6) and to an acceleration cone (3) for a number of acceleration cones (3) at least partially or completely adjoining.

It is also understood that reference is made to an acceleration cone (3) for a connecting piece between two elements, namely a turbine and at least one inflatable envelope (4) or an intake chamber and at least one inflatable envelope (4).

According to some embodiments, one acceleration cone (3) consists of a cylindrical wall or a conical or prismatic wall.

The acceleration cone (3) connects the inlet for surrounding air (1) to at least two inflatable envelopes (4) via preferably at least one intake chamber (6). One intake chamber (6) is the surrounding air and compressed gas mixing zone, i.e. the area where an enriched gas stream is created. At least one intake chamber (6) advantageously connects at least one inlet for surrounding air (1) to at least one inlet of an acceleration cone (3). At least one intake chamber (6) is either integrated with at least one acceleration cone (3) or is an independent part of the device (100).

According to some embodiments, each duct (9) comprises its own intake chamber (6).

According to another preferred embodiment, the wall (8) makes it possible to inflate at least two independent envelopes (4) using a single intermediate chamber (7) with a venturi effect, and a single cylinder of compressed gas (12).

The intermediate chamber (7) with a venturi effect is located between at least one compressed gas inlet (5) and at least one intake chamber (6).

The intermediate chamber (7) is advantageously represented by any means allowing a sectional narrowing of at least one compressed gas inlet (5), allowing the acceleration of the fluid in each of the ducts (9). The compressed gas flow is accelerated by this section narrowing, and causes a depression in the intake chamber, which draws in the surrounding air.

Figure 2:
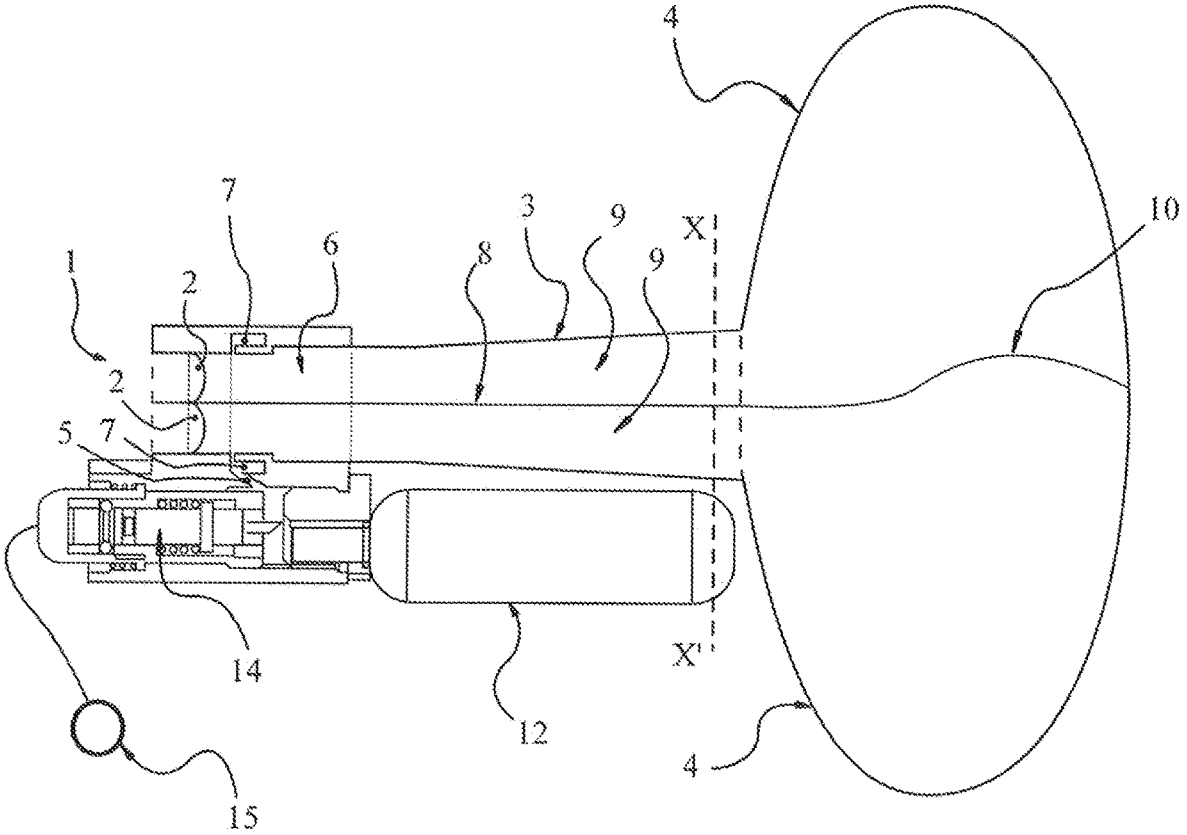
FIG. 2 is a sectional view of the portable nonreturn valve device, according to one embodiment of the invention.

Thus, according to one embodiment, as illustrated in FIG. 2, the portable nonreturn valve device (100) capable of inflating multiple envelopes is in the form of an acceleration cone (3) connected to a cylinder of compressed gas (12), to an inlet for surrounding air (1) and two inflatable envelopes (4). The device further comprises an intake chamber (6) connecting the inlet for surrounding air (1) and the acceleration cone (3). It should be noted that an intermediate venturi effect chamber (7) is located between a compressed gas inlet (5) and an intake chamber (6). The compressed gas cylinder (12) is connected to a firing pin (14), itself connected to an activation handle (15). A separation wall (8) runs through the device (100) of the inlet for surrounding air (1), closed by two nonreturn valves (2), at the inlet of the two inflatable envelopes (4).

FIG. 2 also illustrates that the intermediate chamber (7) is represented by an annular duct at the periphery of at least one intake chamber (6) into which channels open into the side wall of the intake chamber (6).

According to another embodiment, the device (100) includes a number of compressed gas inlets (5) connected to at least one compressed gas cylinder (12).

Figure 3:
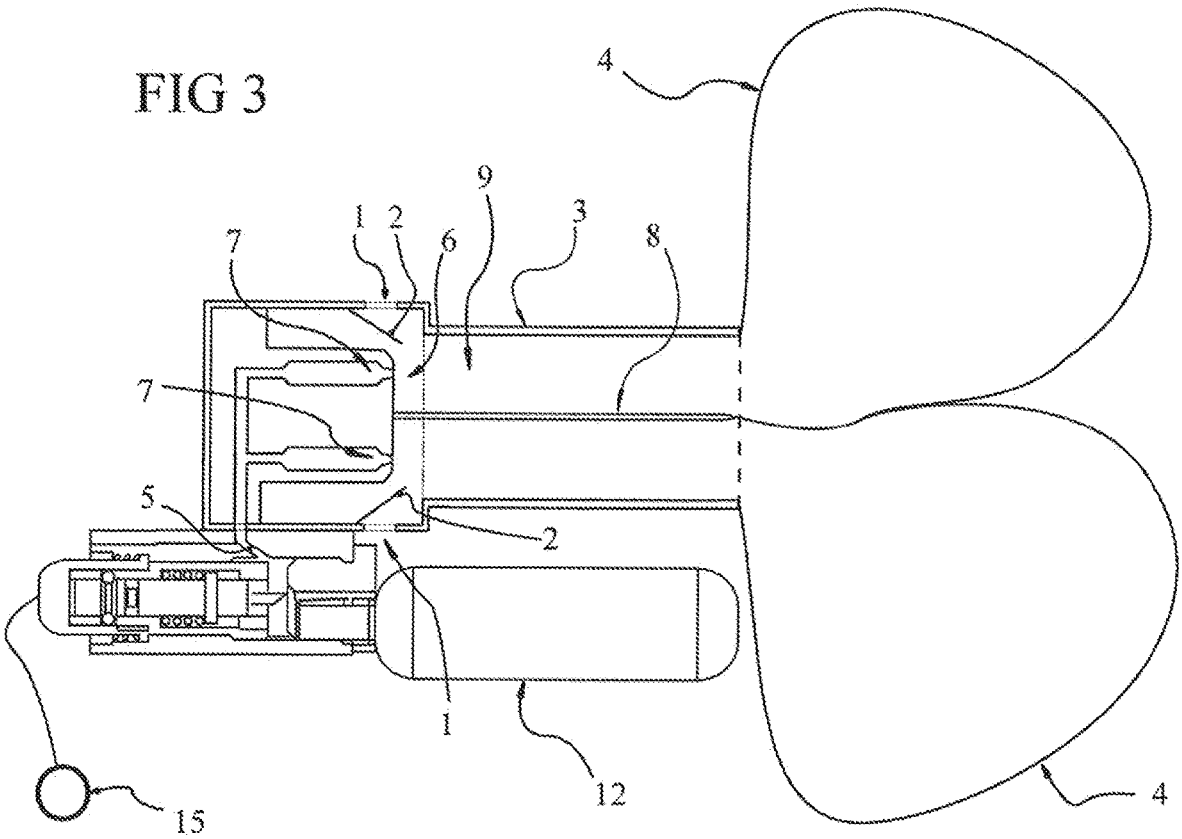
FIG. 3 is a sectional view of the portable nonreturn valve device, according to another embodiment of the invention.

According to a particular embodiment, illustrated in FIG. 3, the intermediate chamber (7) is represented by a compressed gas ejection nozzle opening into a conduit (9) of the acceleration cone (3).

According to this latter embodiment, one ejection nozzle is required per duct (9) and therefore per inflatable envelope (4), substantially hermetically independent.

The compressed gas is advantageously any gas commonly compressed in a cylinder, such as carbon dioxide, nitrogen, argon or air.

Figure 4:
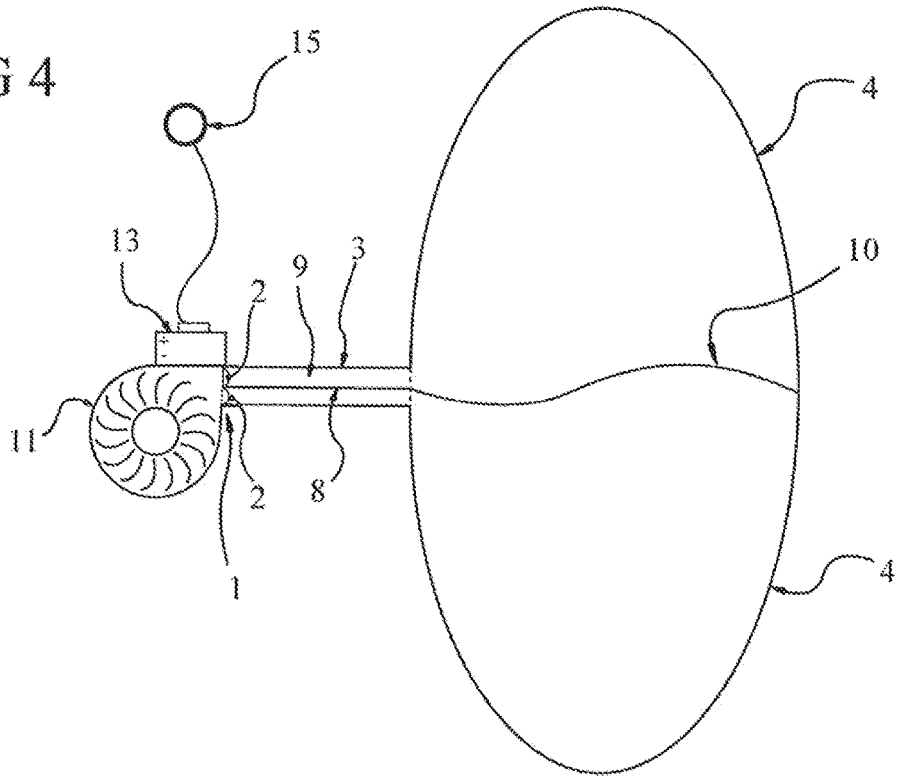
FIG. 4 is a sectional view of the portable nonreturn valve device, according to another embodiment of the invention.

According to another embodiment, illustrated in FIG. 4, the inlet for surrounding air (1) is connected to a turbine (11). The turbine (11) is electrically powered by a battery (13), via a PCB and an electric motor (not shown). The device (100) comprises at one of its ends a turbine (11) connected to an acceleration cone (3), connected to two inflatable envelopes (4). A separation wall (8) runs through the device (100) of the inlet for surrounding air (1), namely the outlet of the turbine (11), at the inlet of the two inflatable envelopes (4). The ducts (9) are closed by at least one nonreturn valve located between the inlet for surrounding air (1) of the turbine (11) and the inlet of the two inflatable envelopes (4).

It is understood that according to the previous embodiment, the inlet for surrounding air (1), the outlet of the turbine (11) and the inlet of the acceleration cone (3) are either merged or adjoining.

The device (100) according to some embodiments, consists of a succession of parts that fit into each other.

The separation wall (8) according to the previous embodiments in is either in one part and is thus advantageously adapted to slide in the succession of parts, or consists of several parts that fit between them substantially hermetically.

According to one embodiment, the constituent parts of the wall (8) are integrated in the fittable parts.

Figure 6:
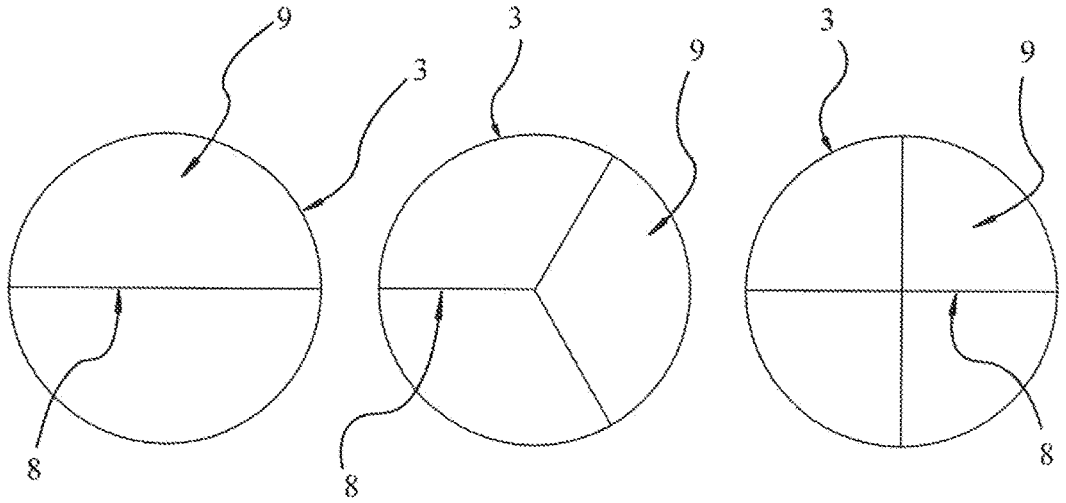
FIG. 6 shows sectional views along (X-X') of different embodiments of the invention.

According to some embodiments, illustrated in FIG. 6, the device (100) comprises at least two walls (8), preferably convergent, capable of inflating at least two envelopes (4), preferably at least three envelopes (4), more preferably at least four envelopes (4).

Figure 7:
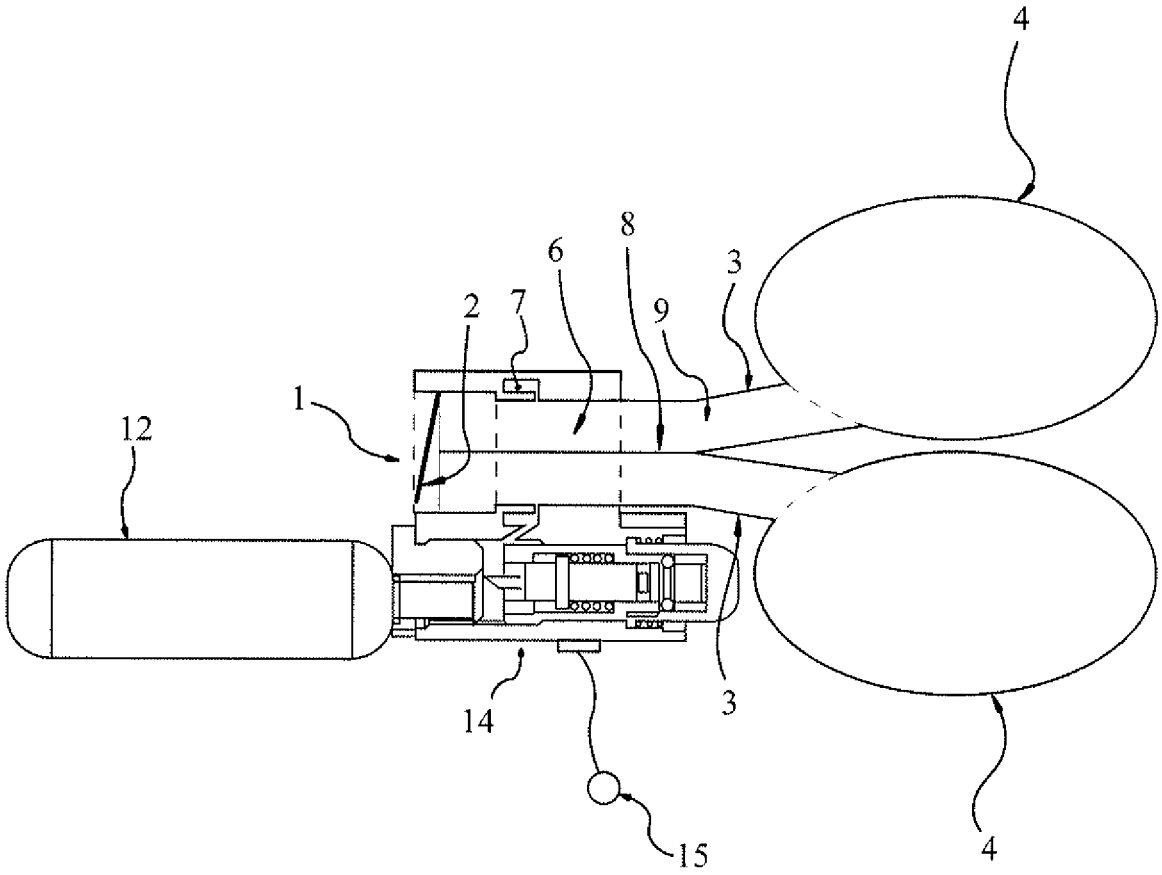
FIG. 7 shows a sectional view of the portable nonreturn valve device, according to another embodiment of the invention.

According to some embodiments, the end of the acceleration cone (3) opening into at least two inflatable envelopes (4) is according to one embodiment, as illustrated in FIG. 7, divided into as many outlets as of envelopes (4) to inflate. According to this embodiment, each envelope (4) marries an outlet of the acceleration cone (3).

FIG. 7 also illustrates a single nonreturn valve (2) simultaneously closing two ducts (9).

According to the preceding embodiments, each outlet of the acceleration cone (3) advantageously plays the role of an acceleration cone (3).

It is understood that according to the preceding embodiments, at least one separation wall (8) runs through the device (100) from at least one nonreturn valve (2) at least at the end of the acceleration cone (3) whose outlet is divided into as many outlets as envelopes (4) to inflate.

It is also understood that according to the preceding embodiments, the device (100) comprises as many ducts (9) as envelopes (4) to inflate.

According to another embodiment, the acceleration cone (3) comprises a single outlet and it is at least one separation wall (8) which delimits the inlets of each envelope (4). Each inflatable envelope (4) is suitably attached to the outlet of the cone (3) and to at least one separation wall (8).

According to one embodiment, the inflatable envelopes (4) are separated and advantageously located on either side of the user.

According to another embodiment, the inflatable envelopes (4) are represented by envelopes delimited by a large volume pocket comprising at least one partitioning membrane (10). This partitioning membrane (10) has a larger area than the section of the large volume pocket where it is fixed.

According to the preceding embodiment, in the context of a pressure differential between the inflatable envelopes (4), the partitioning membrane (10) deflects and balances the filling rate of each envelope.

A pressure differential is generally generated during the presence of an opposition force, in particular on one side, during the inflation process of the envelopes (4).

According to one embodiment, the inflatable envelopes (4) are assembled together, and the walls delimiting them advantageously have the ability to move or deflect, in order to balance the rate of filling each envelope during a pressure imbalance.

The inflatable envelopes (4) are advantageously of all shapes.

The inflatable envelopes (4) being independent, an inadvertent bursting of an envelope advantageously has no major influence on the stability of the second undamaged half of the device (100) according to the invention.

The nonreturn valve (2) is advantageously a nonreturn membrane.

According to one embodiment, the nonreturn membrane is advantageously in the form of a disk and has a slot, preferably circular, such as a heart valve.

According to another embodiment, the nonreturn valve (2) consists of a rigid wall.

According to another variant, the nonreturn valve (2) is a membrane, advantageously fixed to one or two points (s) of the inner wall of the device (100), which contorts under the action of a depression or an overpressure.

According to one embodiment, each duct (9) advantageously comprises an independent nonreturn valve (2) at its end connected to the inlet for surrounding air (1).

According to another embodiment, the ducts (9) are closed by a single nonreturn valve (2) at their ends, connected to the inlet for surrounding air (1). Thus one nonreturn valve (2) closes several ducts (9).

Figure 5:
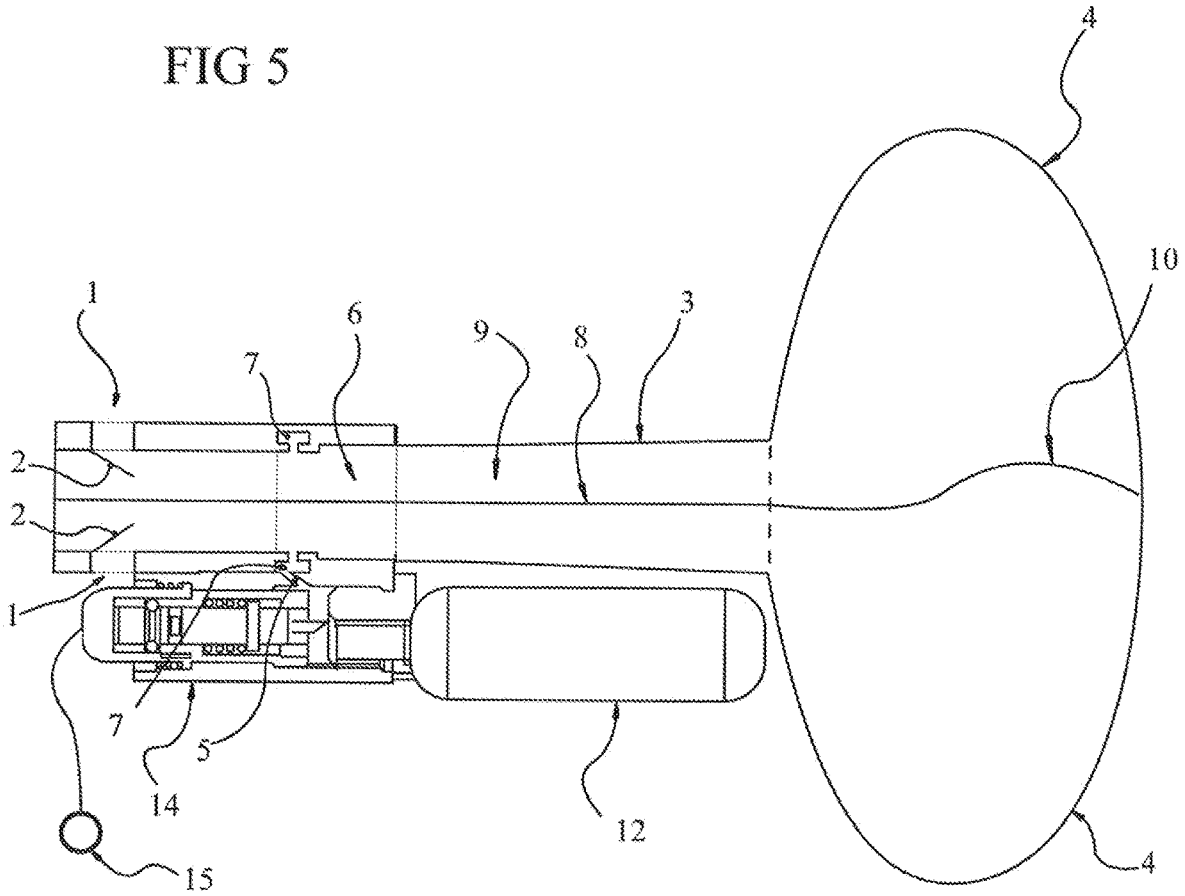
FIG. 5 is a sectional view of the portable nonreturn valve device, according to one embodiment of the invention.

The inlet for surrounding air (1) communicates either longitudinally through the acceleration cone (3), as illustrated in FIG. 2, or laterally as illustrated in FIG. 5. The nonreturn valves (9) are adapted to these different orientations.

The invention claimed is:

1. A portable safety device (100) capable of inflating multiple envelopes comprising:

at least one inlet for surrounding air (1), at least one means of inflation, at least one air or enriched gas zone, at least one nonreturn valve (2), at least one acceleration cone (3), wherein the device (100) further comprises at least one separation wall (8) which compartmentalizes at least an end of the at least one acceleration cone (3) that opens into at least two substantially hermetically independent inflatable envelopes (4).

2. The device (100) according to claim 1, further comprising at least one compressed gas inlet (5), at least one intake chamber (6) connected to the at least one inlet for surrounding air (1), said intake chamber (6) corresponding to the enriched gas zone, and at least one intermediate chamber (7) with a venturi effect, wherein the said intermediate chamber(s) (7) is/are located between the at least one compressed gas inlet (5) and the at least one intake chamber (6).

3. The device (100) according to claim 1, wherein the at least one inlet for surrounding air (1) is connected to a turbine (11), powered by an electrical source, while a zone located downstream of the turbine (11) corresponds to the enriched gas zone.

4. The device (100) according to claim 1, wherein the separation wall (8) compartmentalizes the at least one air or enriched gas zone at least at the end of the at least one acceleration cone (3) opening into the at least two inflatable envelopes (4).

5. The device (100) according to claim 1, wherein the separation wall (8) compartmentalizes the at least the inlet for surrounding air (1) at least at the end of the at least one cone of acceleration (3) opening into the at least two inflatable envelopes (4).

6. The device (100) according to claim 1, wherein the separation wall (8) compartmentalizes at least one portion of the at least one acceleration cone (3), from the at least one nonreturn valve (2), to at least the end of the at least one acceleration cone (3) opening into the at least two inflatable envelopes (4).

7. The device (100) according to claim 1, wherein the at least one separation wall (8) forms with an inner wall of the at least one acceleration cone (3), ducts (9) each closed at one end by the at least one nonreturn valve (2), and each connected at its other end to one of the at least two inflatable envelopes (4).

8. The device (100) according to claim 1, wherein the at least one nonreturn valve (2) is located at the inlet for surrounding air (1).

9. The device (100) according to claim 1, wherein the at least one nonreturn valve (2) is located at the end of at least one acceleration cone (3) emerging in the at least two inflatable envelopes (4).

10. The device (100) according to claim 1, wherein the device comprises at least two separation walls (8) for inflating at least three inflatable envelopes (4).

11. The device (100) according to claim 1, wherein the at least one acceleration cone (3) includes an end which comprises multiple openings adapted to cooperate with multiple inflatable envelopes (4).

12. The device (100) according to claim 1, wherein the at least one acceleration cone (3) comprises at least one of a cylindrical wall, a conical wall, a prismatic wall.

* * * * *